US011946179B2

(12) United States Patent
Petersen

(10) Patent No.: US 11,946,179 B2
(45) Date of Patent: Apr. 2, 2024

(54) FORMER HEAD AND AN APPARATUS COMPRISING SUCH A FORMER HEAD

(71) Applicant: Campen Machinery A/S, Hornslet (DK)

(72) Inventor: Jens Erik Thordahl Petersen, Rønde (DK)

(73) Assignee: Campen Machinery A/S, Hornslet (DK)

( * ) Notice: Subject to any disclaimer, the term of this patent is extended or adjusted under 35 U.S.C. 154(b) by 435 days.

(21) Appl. No.: 17/290,003

(22) PCT Filed: Nov. 14, 2019

(86) PCT No.: PCT/EP2019/081341
§ 371 (c)(1),
(2) Date: Apr. 29, 2021

(87) PCT Pub. No.: WO2020/104289
PCT Pub. Date: May 28, 2020

(65) Prior Publication Data

US 2022/0001573 A1 Jan. 6, 2022

(30) Foreign Application Priority Data

Nov. 21, 2018 (DK) ..... PA201870771

(51) Int. Cl.
*D04H 1/732* (2012.01)
*D01G 21/00* (2006.01)
*D04H 1/736* (2012.01)

(52) U.S. Cl.
CPC ..... *D04H 1/732* (2013.01); *D01G 21/00* (2013.01); *D04H 1/736* (2013.01)

(58) Field of Classification Search
CPC ..... D01G 21/00; D04H 1/732; D04H 1/736
See application file for complete search history.

(56) References Cited

U.S. PATENT DOCUMENTS 2,738,557 A 3/1956 Anderson et al.
2,931,076 A 4/1960 Clark
(Continued)

FOREIGN PATENT DOCUMENTS

EP 1440197 A1 7/2004
GB 1516573 A 7/1978
(Continued)

OTHER PUBLICATIONS

Danish Search Report for Danish Patent Application No. PA2018 70771, dated May 9, 2019 in 1 page.
(Continued)

*Primary Examiner* — Shaun R Hurley
(74) *Attorney, Agent, or Firm* — Knobbe Martens Olson & Bear LLP

(57) ABSTRACT

The invention relates to a former head of the kind which is used for forming, such as dry forming, of a fibrous web, where fibers are supplied to the former head mixed with air via at least one injection inlet. The former head comprising: a) a roller being rotatable in a rotation direction around a rotation axis and comprising: a roller surface surrounding the rotation axis, and a plurality of projections extending outwardly, such as radially outwardly, from the roller surface, b) a screen extending along at least part of the roller surface above the rotation axis, the roller surface and the screen defining therebetween a peripheral gap, and c) the injection inlet, wherein the injection inlet is positioned to conduct the mixture of the fibers and air into the peripheral gap in a delivery direction opposite or substantial opposite to the rotation direction of the roller.

16 Claims, 10 Drawing Sheets

(56) References Cited

U.S. PATENT DOCUMENTS

| | | | | |
|---|---|---|---|---|
| 4,030,865 | A | 6/1977 | Kobayashi | |
| 4,366,111 | A | 12/1982 | Dinius | |
| 4,375,447 | A * | 3/1983 | Chung | D01G 99/00 264/114 |
| 2005/0098910 | A1 | 5/2005 | Andersen | |
| 2008/0241301 | A1 * | 10/2008 | Norgaard | D04H 1/64 264/103 |
| 2014/0034399 | A1 * | 2/2014 | Dilo | D04H 1/736 19/105 |
| 2014/0331456 | A1 * | 11/2014 | Wu | D04H 1/43838 19/305 |

FOREIGN PATENT DOCUMENTS

| | | | | |
|---|---|---|---|---|
| WO | 03/016605 | A1 | 2/2003 | |
| WO | WO-2005106091 | A1 * | 11/2005 | D04H 1/425 |
| WO | 2017/122182 | A1 | 7/2017 | |

OTHER PUBLICATIONS

International Search Report for International Patent Application No. PCT/EP2019/081341, dated Mar. 12, 2020 in 3 pages.

* cited by examiner

FORMER HEAD AND AN APPARATUS COMPRISING SUCH A FORMER HEAD

CROSS-REFERENCE TO RELATED APPLICATIONS

This application is the U.S. National Phase under 35. U.S.C. § 371 of International Application PCT/EP2019/081341, filed Nov. 14, 2019, which claims priority to Danish Patent Application No. PA201870771, filed Nov. 21, 2018. The disclosures of the above-described applications are hereby incorporated by reference in their entirety.

TECHNICAL FIELD

The present invention relates to a former head for forming a fibrous web and an apparatus comprising such former head and a former wire.

BACKGROUND ART

Various methods are known for producing nonwoven fibrous webs, such as dry formed fibrous webs, from a source of pre-formed bulk fibres. Such pre-formed bulk fibres typically undergo a considerable degree of entanglement, inter-fibre adhesion, agglomeration, or "matting" after formation or during storage prior to use in forming a nonwoven web. One particularly useful method of forming a web from a source of pre-formed bulk fibres involves dry forming, which generally involves providing the pre-formed fibres in a well-dispersed state in air, then collecting the well-dispersed fibres on a former wire as the fibres settle through the air under the force of gravity, optionally supplemented with a vacuum suction box below the former wire to suck the fibres towards the former wire.

EP1440197 discloses a former head for dry forming nonwoven fibrous webs using pre-formed bulk fibres comprising a needle roller covered by an adjustable screen shaped like the periphery of the needle roller, where the screen may be equipped at the underside with means for separating fibres and where a mixture of air and fibres is conducted to the former head from an injection nozzle in a direction coincides with the rotation direction of the needle roller.

SUMMARY OF THE INVENTION

It is an object of the present invention to decrease the energy usage of the former head and/or to improve the separation effect of the fibres provided by the former head.

Another object of the invention is to provide a former head having a simple construction and being more compact, i.e. taking op less floor space.

According to the invention is provided a former head for forming, such as dry forming, of a fibrous web, where fibres are supplied to the former head mixed with air via at least one injection inlet. The former head comprises:

a) a roller being rotatable in a rotation direction around a rotation axis and comprising:
   - a roller surface surrounding the rotation axis, and
   - a plurality of projections extending outwardly, such as radially outwardly, from the roller surface, b) a screen covering or extending along at least part of the roller surface above the rotation axis, so that at least part of the screen is situated above a horizontal plane extending through the rotation axis of the roller, the roller surface and the screen defining therebetween a peripheral gap, and c) the injection inlet being positioned to conduct the mixture of the fibres and air into the peripheral gap in a delivery direction, characterised in that the delivery direction is opposite to the rotation direction of the roller, and in that the screen comprises an air inlet communicating with the peripheral gap and arranged before the injection inlet when viewed in the rotation direction of the roller.

The screen preferably is air impervious, and may preferably be defined by a metal plate bent to assume a curved configuration.

Hereby is obtained an improved disentanglement of the fibres through collisions between the entangled fibres and the projections. This is a result of the fibres suspended in the air being introduced/injected into the aforementioned peripheral gap in a direction opposite or substantially opposite to the rotation direction of the roller, which gives rise to heavy impacts of the fibres against the plurality of projections moving in a direction counter to the airflow.

Subsequently the fibres are conveyed in the rotation direction of the roller by the projections on the roller. The fibres subsequently fall off the roller to settle or be sucked onto a forming wire. Due to the impacting, the velocity of the air or airstream supplied through the injection inlet may be reduced, while obtaining an at least equally good separation and/or dispersion of the fibres. With the present invention the velocity of the air or airstream may e.g. be regulated from 100 m/s or more to 10-50 m/s, preferably between 20-25 m/sec, without obtaining less effective separation and/or dispersion of the fibres. The use of air supplied through the injection inlets with a lower velocity has an effect on the energy usage of the former head, whereby the energy usage also is decreased.

Furthermore, with the invention is provided a former head having a more compact and simple design or construction, i.e. comprising only one former roller, and providing a sufficient separation and/or dispersion of the fibres to be laid or settled on the former wire.

The fibres may preferably be fed to the former head via the injection inlet to strike/impact the rotating roller in a direction offset a plane extending through the rotation axis of the roller. The plane extending through the rotation axis may be a vertical or substantially vertical plane.

As will be understood the above impacting effect is not obtained when delivering of the mixture of the fibre material and air into the peripheral gap is oriented in the general direction of the rotation direction of the roller.

The fibres may comprise natural fibres, synthetic fibres or a mixture hereof. The natural fibres may e.g. be fibres that are produced by plants, animals, and/or geological processes, like wood pulp, hemp, flax, cotton or similar. The synthetic fibres may e.g. be Polypropylene, Polyethylene, Polyester, Polylactic acid (PLA fibre), Viscose, Carbon fibre, Rayon, Stone wool, Glass fibre, Ceramic fibre, super absorber fibre etc. The length of the fibres may typically be between 1-25 mm. Alternatively, granules having a sugar like structure or superabsorbent granules may be used, either alone or mixed with anyone or more of the above-mentioned fibres.

The fibrous web formed by the former head may weigh e.g. 5-10,000 g per 1 $m^2$ fibrous web.

The length of the roller may be between 250-6,000 mm. The length being defined as extending between two roller ends along the rotation axis of the roller.

The roller surface may rotate at a speed of between 300-3000 rpm, i.e. corresponding to a peripheral velocity of approximately 7-7.5 m/s, preferably between 20-35 m/s.

An underside of the screen may be shaped like the periphery of the roller surface, wherein the roller surface and the underside of the screen defines therebetween the peripheral gap. The underside of the screen and the roller surface may have coinciding centre axes, wherein the centre axes are coinciding with the rotation axis of the roller.

The injection inlet may have a length corresponding to the length of the roller. Alternatively, two or more injection inlets may be provided to cover the entire or substantially the entire length of the roller. The injection inlets may be arranged in line with the rotation axis of the roller. The one or more injection inlets may be longitudinal injection inlets. The one or more injection inlets may be an injection nozzle.

The former head may comprise two end walls, one at each end of the roller, wherein the screen and the two end walls together constitute a housing enclosing the roller.

The air inlet may be used as an airlock to block the air or airstream comprising the fibres from the injection inlet from flowing in the opposite direction than the rotation direction of the roller within the peripheral gap. The air or airstream from the air inlet may be supplied in a supply direction oriented towards or substantially towards the rotation axis of the roller and at least following the opposite direction than the rotation direction of the roller within the peripheral gap when hitting the roller. The air inlet may be provided along the circumference of the screen e.g. in the second portion of the screen. The air inlet may also be used for providing a sufficient separation and/or dispersion of the fibres to settle or be laid on the former wire According to one embodiment, the plurality of projections extending from the roller surface are defined by pins or needles, needle strips, a carding plate, carding plate segments, carding wires, blade flails, a rasping plate, rasping plate segments or similar. Wherein blade flails also are known as hammers or flail hammers. Needle strips as referred to herein may be bands to which needles are mounted and that are subsequently mounted to the roller surface. Preferably, the projections are flexibly bendable and capable to reassume their original shape after bending.

The pins/needles or the needles on the needle strips may have a length between 15-125 mm. The needles may be either cylindrical or conical shaped or have any other suitable shape.

The needles and/or the blade flails may be arranged in rows extending along the length of the roller. The number of rows of needles, needle strips, carding wires or rows of blade flails may vary from a minimum of four rows of needles, needle strips, carding wires or rows of blade flails to as many as may be fitted on the roller surface. The rows of needles, the needle strips, the carding wires or rows of blade flails may be arranged parallel with the rotation axis of the roller. Alternatively, the rows of needles, the needle strips, the carding wires or rows of blade flails may be arranged in a spiral around the roller. The rows of needles, the needle strips, the carding wires or rows of blade flails may be arranged on the roller surface with a constant or varying distance in-between each row of needles, needle strip, carding wire or row of blade flails. There may be e.g. at least four rows of needles, needle strips, carding wires or rows of blade flails arranged with an approximately 90 degrees distance in-between each row of needles, needle strip, carding wire or row of blade flails.

The carding plate may include one carding plate covering or extending along the entire surface of the roller or comprise a plurality of carding plate segments, wherein the plurality of carding plate segments are arranged on the roller surface to cover the entire roller surface or at least parts of the roller surface.

The carding wires may be attachable to the roller surface.

Blade flails may include different types of flat blade flails being attachable to the roller surface.

The rasping plate may include one rasping plate covering or extending along the entire surface of the roller or comprise a plurality of rasping plate segments, wherein the plurality of rasping plate segments are arranged on the roller surface to cover the entire roller surface or at least parts of the roller surface. The rasping plate or rasping plate segments may comprise projections having a projection depth of between 0.1-15 mm.

According to one embodiment, the underside of the screen is provided with a plurality of projections extending outwardly, such as radially outwardly, from the underside of the screen, such as needles, needle strips, a carding plate, carding plate segments, carding wires, a rasping plate, rasping plate segments or similar.

Hereby is provided a further improved disentanglement of the entangled fibres conveyed within the peripheral gap between the roller surface and the screen.

A screen being provided with needles or needle strips may be used together with a roller provided with needles or needle strips. A screen being provided with a carding plate or carding plate segments may be used together with a roller provided with a carding plate or carding plate segments. A screen being provided with carding wires may be used together with a roller provided with carding wires. A screen being provided with a rasping plate or rasping plate segments may be used together with a roller provided with a rasping plate or rasping plate segments.

As an alternative the underside of the screen may have a smooth surface. The smooth surface may be a perforated smooth surface accommodating an air intake into the peripheral gap. A smooth surface may e.g. be used together with a roller where the projections extending from the roller surface are needles, needle strips or blade flails.

The needles may be arranged in rows extending along the length of the screen. The row of needles, the needle strips or the carding wires may be arranged parallel with the rotation axis of the roller. The carding wires may be attachable to the screen, i.e. the underside of the screen. The row of needles, the needle strips or the carding wires may be arranged on the underside of the screen with a constant or varying distance in-between each row of needles, needle strips or carding wires. Each row of needles, needle strips or carding wires may be arranged with a distance in-between each row of needles, needle strips or carding wires corresponding to the distance between the rows of needles, needle strips or carding wires on the roller.

The carding plate may include one carding plate covering or extending along the entire underside of the screen defining the peripheral gap or comprise a plurality of carding plate segments, wherein the plurality of carding plate segments are arranged on the underside of the screen to cover the entire underside of the screen defining the peripheral gap or at least parts of the underside of the screen defining the peripheral gap.

The rasping plate may include one rasping plate covering or extending along the entire underside of the screen defining the peripheral gab or comprise a plurality of rasping plate segments, wherein the plurality of rasping plate segments are arranged on the underside of the screen to cover the entire underside of the screen defining the peripheral gap or at least parts of the underside of the screen defining the peripheral gap. The rasping plate or rasping plate segments may comprise projections having a projection depth of between 0.1-15 mm.

According to one embodiment, the screen comprises an injection opening extending along the rotation axis of the roller, the injection opening in the screen at least partially or fully partition the screen into two portions, a first portion extending from the injection opening and along the rotation direction of the roller and a second portion extending from the injection opening and in a direction opposite of the rotation direction of the roller.

The injection opening may be situated above the horizontal plane extending through the rotation axis of the roller. The injection opening may extend along the entire or substantially the entire length of the roller. Alternatively, two or more injection openings may be provided along the rotation axis of the roller to cover the entire or substantially the entire length of the roller. The injection openings may be arranged in line with the rotation axis of the roller. The one or more injection openings may be longitudinal injection openings.

According to one embodiment, the air inlet comprises one or more perforated plates arranged along the circumference of the screen and said perforated plates being slidable relative to the screen between an open and a closed position.

According to one embodiment, the air inlet comprises one or more manifold arranged along the circumference of the screen or said air inlet comprises one or more air blasting units arranged on the screen. By using an air blasting unit, it is possible to provide compressed air into the peripheral gap of the screen of the former head. The air flow can be regulated by using a fan having means for adjusting the speed of the fan. The air flow from the fan would be blown in to the former head through a hole in the screen, preferably a perforated region in the former head.

The air inlet may be used as an airlock to block the air or airstream comprising the fibres from the injection inlet from flowing in the opposite direction than the rotation direction of the roller within the peripheral gap. The air or airstream from the air inlet may be supplied in a supply direction oriented towards or substantially towards the rotation axis of the roller and at least following the opposite direction than the rotation direction of the roller within the peripheral gap when hitting the roller. The air inlet may be provided in the second portion of the screen. The airlock may further comprise:

- a second group of projections extending outwardly, such as radially outwardly, from the underside of the second portion of the screen and being arrange between the injection inlet and the air inlet, and/or
- an end piece arranged before the air inlet when viewed in the rotation direction of the roller.

The airlock, i.e. the air inlet and/or the second group of projections and/or the end piece may extend along the entire length or substantially the entire length of the roller. The air inlet may be divided into two, three or more air inlets arranged in a row extending along the entire length or substantially the entire length of the roller. The air inlet may comprise one or more movable valves or shutters configured for varying the airstream or air intake through the air inlet into the peripheral gap. The valves or shutters may be adjusted in order to maintain an air balance between the air or airstream comprising the fibres and the air or airstream from the air inlet, so to prevent the air or airstream comprising the fibres from the injection inlet from reaching the end piece, i.e. from flowing in the opposite direction than the rotation direction of the roller within the peripheral gap. The second group of projections may comprise at least one row of projections extending along the entire length or substantially the entire length of the roller. The end piece may define an end and/or a second exit opening of the peripheral gap.

By means of at least the air inlet is provided an airlock ensuring that at least a majority of the supplied fibres or at least the entangled fibres are conveyed in the rotation direction of the roller and exits the peripheral gap at a first exit opening of the peripheral gap. The second group of projections together with the plurality of projections on the roller, provides a further impacting effect to the supplied fibres. The end piece leads the air or airflow from the air inlet towards and in-between the projections on the roller and through second exit opening of the peripheral gap in the order to clean the roller projections from fibres attached the projections, before the projections are exposed to new fibres from the injection inlet.

According to one embodiment, the underside of the first portion of the screen comprises a first group of projections, the first group of projections being used for separating and/or dispersing the fibres in the peripheral gap between the roller surface and the screen.

According to one embodiment, the peripheral gap has a decreasing width from the injection opening in the screen and in the rotation direction of the roller.

The width of the peripheral gap may decrease width up to e.g. 40% at the end furthest from the injection opening, i.e. at the first exit opening of the peripheral gap, compared to the width of the peripheral gap at the injection opening.

In order to obtain the decreasing width of the peripheral gap, the radius of the screen may be continually decreasing from the injection opening in the screen and in the rotation direction of the roller. In this embodiment of the invention the underside of the screen may comprise grooves extending in the rotation direction wherein the plurality of projections may run as the roller rotates.

Hereby is provided an alternative to improve the separation and/or dispersion of the fibres within the peripheral gap between the roller and the screen.

According to one embodiment, the plurality of projections on both the roller surface and the underside of the screen are needles or needle strips, so that the width of the peripheral gap and a length of the needles on the underside of the screen and a length of the needles on the roller surface of the roller provides a needle overlap between respectively the needles extending from the underside of the screen and the roller surface.

The needle overlap may be between 0-95% of the length of the needles extending from respectively the roller and the screen, i.e. the underside of the screen.

The invention further is concerned with an apparatus for depositing fibres on a forming wire comprising at least one former head as described above, the forming wire configured to move in a wire direction and for receiving the fibres from the at least one former head.

Hereby is provided an apparatus with a former head as described above having a compact and more simple design i.e. comprising only one roller, and providing a sufficient separation and/or dispersion of the fibres to settle or be laid on the former wire.

BRIEF DESCRIPTION OF THE DRAWINGS

The invention will now be explained in further details with reference to the figures showing an aspect thereof.

DETAILED DESCRIPTION

The invention relates to a former head 1 of the kind is used for forming a fibrous web, such as in a dry forming process. Fibres are supplied to the former head 1, normally in an entangled form, suspended in an airstream. The airstream with the fibres enters the former head 1 via at least one former head injection inlet 2, in a delivery direction DD opposite the rotation direction RD of a roller 10.

Figure 1:
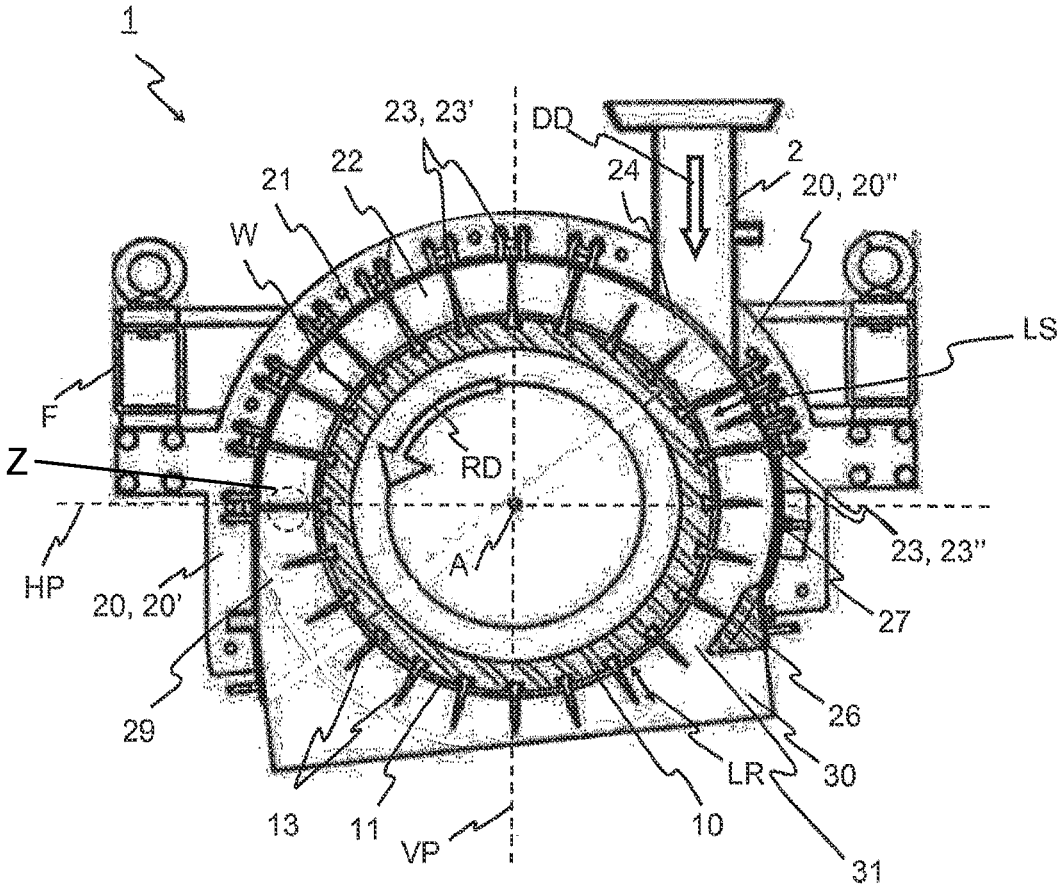
FIG. 1 illustrates a cross sectional view of a former head according to the invention.
Figure 4:
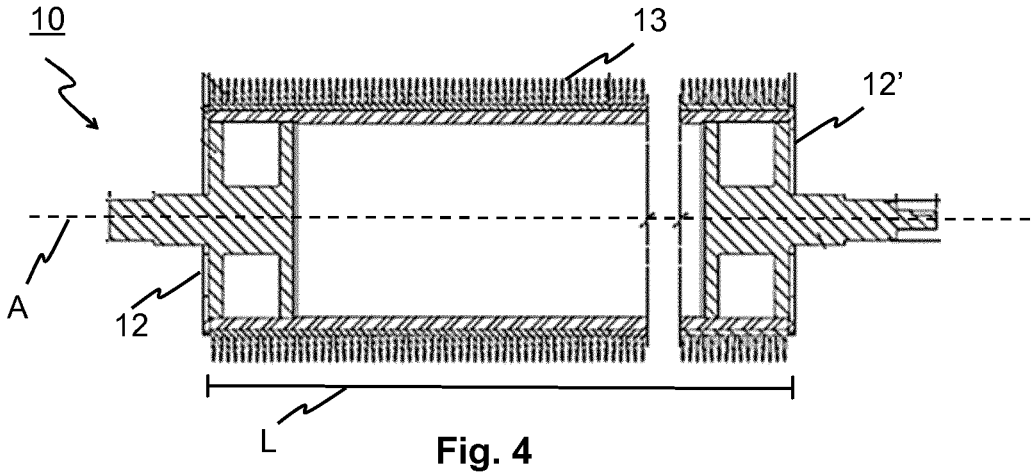
FIG. 4 illustrates a cross sectional view of a roller.

Referring to FIG. 1, the former head 1 according to the invention is shown as comprising the roller 10 which is generally cylindrical and which extends between two roller ends 12, 12', shown in FIG. 4. The roller 10 is mounted for rotation in the rotation direction RD around a rotation axis A, and an air impervious structure referred to in the following as screen 20 covers or extends along at least part of an upper side of the roller 10, in the shown example along at least a portion of the roller 10 above a horizontal plane HP extending through the rotation axis A.

In the presently illustrated embodiment the entire upper side of the roller 10 is covered by the screen 20 which has an injection opening 24 through which the mixture of fibres and air is supplied via the injection inlet 2. The injection opening 24 in the screen 20 is arranged at a level above the aforementioned horizontal plane HP. The screen 20, or an underside 21 of the screen 20, is shaped to provide a peripheral gap 22 between the underside 21 of the screen 20 and the surface 11 of the roller 10. In the presently illustrated embodiment the provided peripheral gap 22 has a constant or substantially constant width W.

The roller 10 is provided with a plurality of projections 13 extending radially outwardly from the roller surface 11. In the presently illustrated embodiment the plurality of projections 13 are twenty-four rows of pointed needles/pins, or twenty-four needle strips extending along the length L, shown in FIG. 4, of the roller 10 parallel with the rotation axis A, also shown in FIG. 4, wherein each needle has a length LR. The number of rows of needles or needle strips may vary from a minimum of e.g. four rows of needles or needle strips to as many as may be fitted on the roller surface 11. The rows of needles or needle strips may in the presently illustrated embodiment arranged on the roller surface 11 with a constant or substantially constant distance in-between each row of needles or needle strips and in-between the individual needles.

Figure 10:
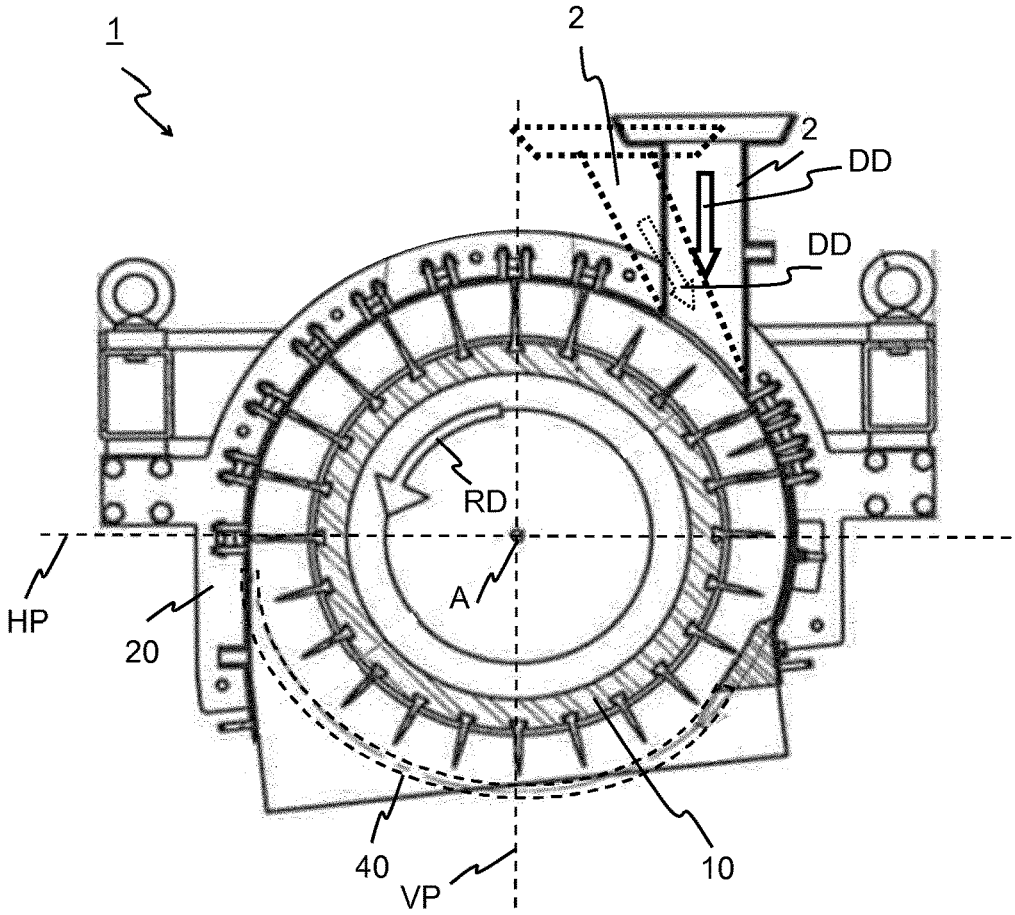
FIG. 10 illustrates a cross sectional view of a former head having a perforated plate extending along a bottom part of the roller.
Figure 11:
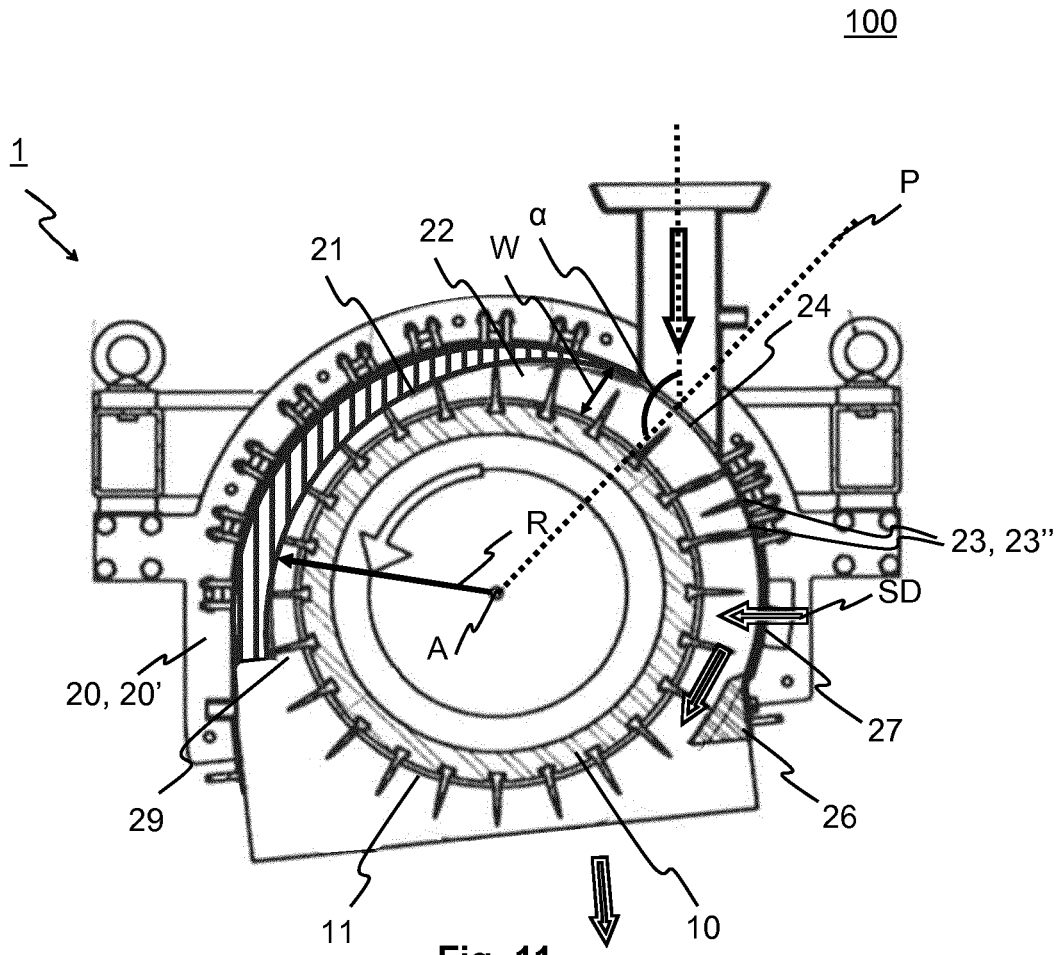
FIG. 11 illustrates a cross sectional view of a former head having a peripheral gap with a varying width.

In the presently illustrated embodiment the delivery direction DD of the mixture of fibre and air and thus the orientation of the injection inlet 2 is parallel with a vertical plan VP extending through the rotation axis A. The delivery direction DD may vertically downward or substantially vertically downward. As an alternative and as shown in broken line in FIG. 10, the delivery direction DD, and thereby the orientation of the injection inlet 2, may be inclined relative to a plane parallel with the vertical plane VP, with the delivery direction DD remaining opposite or substantially counter to the rotation direction RD of the roller 10. This is in order to ensure in any case that as the flow of air with fibres enters the peripheral gap 22 the entangled fibres will collide with the plurality of projections 13 moving in a direction against the flow of fibres, thereby proving a strong impacting force on the fibres. As shown in FIG. 11, by the term "substantially counter to the rotation direction RD of the roller 10" is meant that an angle $\alpha$ between a plane P extending through the rotation axis A of the roller 10 and towards or through the outlet of the injection inlet 24 and the delivery direction DD is less than 180 degrees.

The screen 20 may additionally be provided with a plurality of projections 23, 23', 23" extending radially from the underside 21 of the screen 20 into the peripheral gap 22. The plurality of projections 23, 23, 23" may be divided into two groups of projections. A first group of projections 23' is provided on a first portion 20' of the screen 20 extending from the injection opening 24 and along the rotation direction RD of the roller 10; this first group of projections 23' assist in the disentanglement of the fibres. A further, second group of projections 23" is provided on a second portion 20" of the screen 20 extending from the injection opening 24 and opposite the rotation direction RD of the roller 10; this second group of projections 23" assist in preventing the fibres from moving in a direction counter to the direction of rotation of the roller 10.

In the presently illustrated embodiment this plurality of projections 23, 23', 23" are rows of pointed needles/pins or needle strips running along the length of the screen 20 parallel with the rotation axis A of the roller 10. Eight rows of needles or needle strips are in the shown example arranged on the first portion 20' of the screen 20 and three rows of needles or needle strips are arranged on the second portion 20" of the screen 20. The needles/pins of each row of needles or needle strip are arranged at a mutual distance corresponding to the mutual distance between the needles in each row on the roller 10 to allow for the passage of the roller projections between the screen projections as the roller 10 rotates. The projections/needles 23, 23', 23" have a length LS, which may be the same for all projections, or which may differ.

Figure 2:
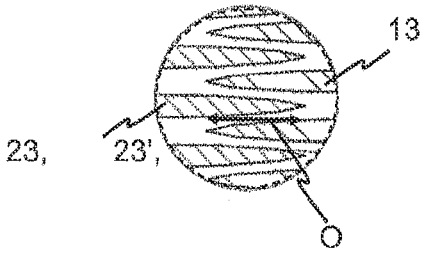
FIG. 2 illustrates a close-up of a needle overlap, as seen down towards the horizontal plane HP at area Z of FIG. 1.

Referring to FIG. 2, the needles/pins or needle strips on respectively the roller surface 11 and the underside of the screen 20 provides an overlap O to increase the separation/disentanglement of the fibres and/or the dispersion of the fibres in the air or airstream. As an alternative the underside 21 of the screen 11 may be a smooth surface (not shown), i.e. without any of the projections referred to.

Returning to FIG. 1, the second portion 20" of the screen 10 may be provided with an air inlet 27 which provides an airlock, allowing an airstream to flow into the peripheral gap 22 in a supply direction SD towards or substantially towards the rotation axis A of the roller 10, wherein the latter airstream SD is guided to flow opposite the rotation direction RD of the roller 10 when hitting the roller 10 and/or entering the peripheral gap 22.

Figure 3:
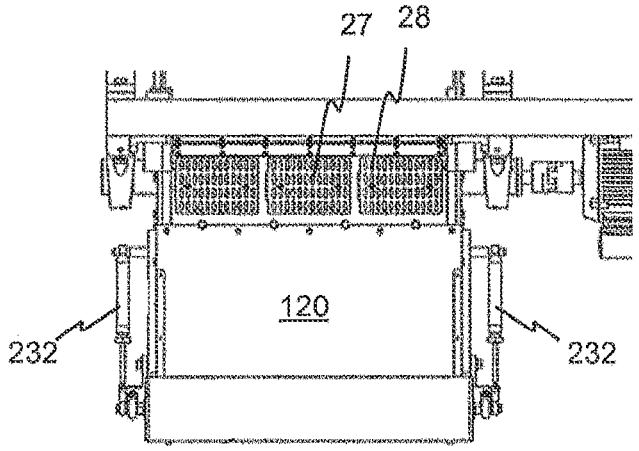
FIG. 3 illustrates a close-up of an air inlet being used as an airlock.

The second portion 20" of the screen 20 may further be provided with an end piece 26 which also may be part of the airlock. Starting from the injection opening 24 in the screen 20 and looking against the rotation direction RD of the roller 10, the second group of projections 23" is arranged closest to the injection opening 24 in the screen 20, the end piece 26 is arranged furthest from the injection opening 24 and the air inlet 27 is arranged there in-between, i.e. between the second group of projections 23" and the end piece 26. As shown in FIG. 3 the air inlet 27 may comprise a perforated plate 28 being respectively openable and closable and being arranged in a second opening in the screen 20 extending along the entire length L or substantially the entire length L of the roller 10 parallel with the rotation axis A of the roller 10, shown in FIG. 4. As an alternative the plate 28 may comprise multiple sections of perforated plates 28 with holes a number of holes 281 (shown in FIG. 15*b*) arranged in one or multiple second openings in the screen 20. The end piece 26 protrudes into the peripheral gap 22 so that the width W of the peripheral gap 22 becomes equal or substantially equal to the length LR of the projections 13 on the roller 10, i.e. in the presently illustrated embodiment the length LR of the needles extending from the roller surface 11. A distance between the tip of the projections 13 and the end piece 26 may be about 1 mm.

The airlock comprising at least the air inlet 27 may assist in ensuring that the supplied fibres are conveyed in the rotation direction RD of the roller 10, to exit the peripheral gap 22 at a first exit opening 29 of the peripheral gap 22. The end piece 26 combined with the air flow SD additionally assist in clearing away fibres remaining on the roller 10 on leaving the gap 22 at exit 29. By using a suction box underneath the former head 1, it is possible to enhance the distribution of the fibres during the step of conveying the fibres onto the former wire 101. During the step of placing the fibres on the former wire, the former wire is able to convey the fibres in the conveying direction, preferably in a continually operation.

Figure 5:
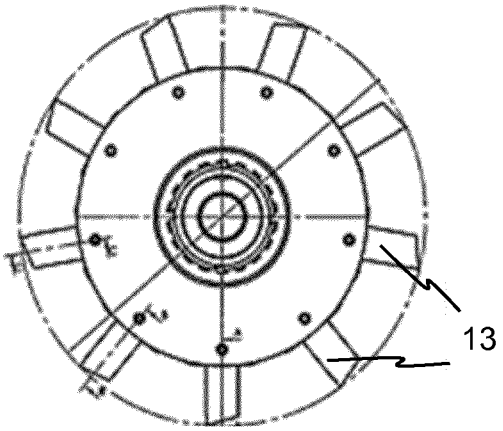
FIG. 5 illustrates a roller comprising blade flail.
Figure 6:
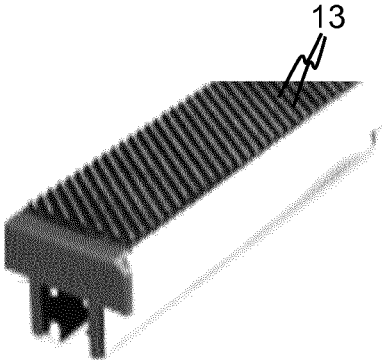
FIG. 6 illustrates a carding plate segment.
Figure 7:
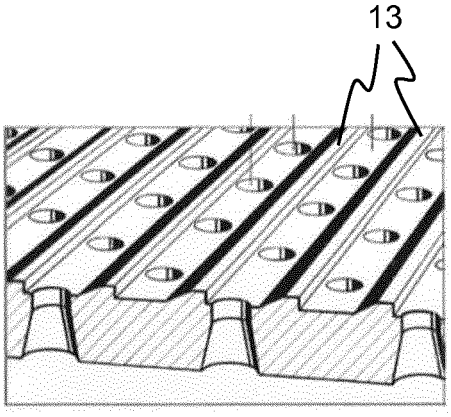
FIG. 7 illustrates a rasping plate.
Figure 8:
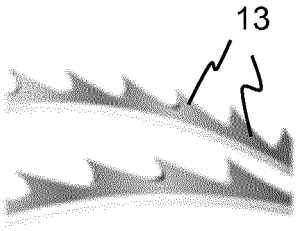
FIG. 8 illustrates a carding wire.

As an alternative to the embodiment illustrated in FIGS. 1 and 4, and now referring to FIGS. 5-8, the plurality of projections 13 on the roller may be replaced by blade flails or rows of blade flails as illustrated in FIG. 5, or a carding plate or carding plate segments as illustrated in FIG. 6, or a rasping plate or rasping plate segments as illustrated in FIG. 7, or carding wires as illustrated in FIG. 8. And the plurality of projections 23, 23', 23" on the screen 20 may be replaced by a carding plate or carding plate segments as illustrated in FIG. 6, or a rasping plate or rasping plate segments as illustrated in FIG. 7, or carding wires as illustrated in FIG. 8. Alternatively, the underside 21 of the screen 11 may be a smooth surface (not shown), i.e. without projections. The smooth surface may be a perforated smooth surface accommodating an air intake into the peripheral gap 22.

Figure 9:
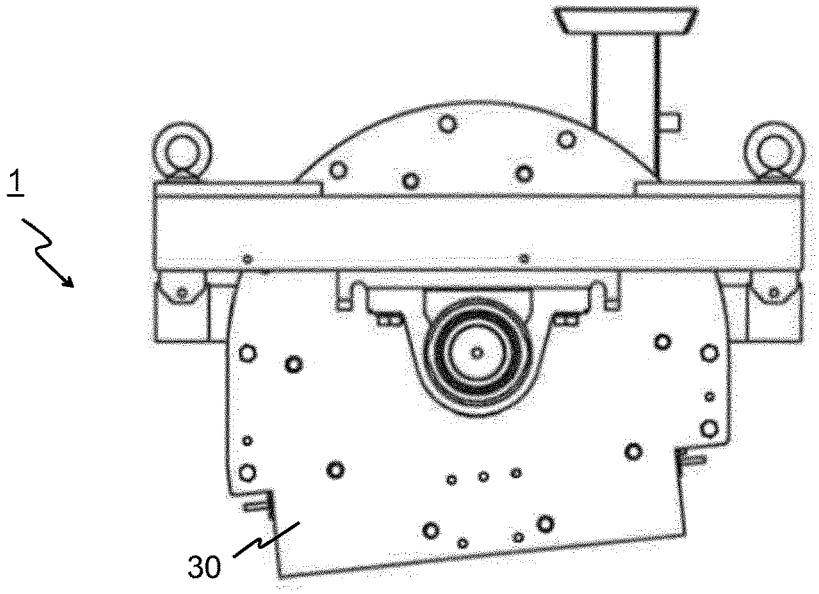
FIG. 9 illustrates an end view of the former head illustrated in FIG. 1.

Now referring to FIG. 9, an end view of the former head 1 illustrated in FIG. 1 is shown wherein the former head 1 comprises two end walls 30 where in-between the screen 20 extends, one of the end walls 30 being shown in FIG. 1 and the other end wall 30 being shown in FIG. 9. The two end walls 30 enclose the roller 10 at each end 12, 12' of the roller 10 (shown in FIG. 4) and provides together with the screen 20 a housing being open in the bottom and thus partly enclosing the roller 10. The orientation of the opening in the bottom may be slightly angled in order to turn or orientate the fibres from the fibre head 1 into the moving direction of the former wire 101, i.e. in the wire direction WD.

Now referring to FIG. 10, the former head 1 may be provided with a perforated plate 40 covering or extending along a lower part of the roller surface 11 below the horizontal plane HP extending through the rotation axis A. The perforated plate 40 may be shaped like the periphery of the roller surface 11 and/or substantially like the periphery of the roller surface 11 and/or extend in continuation of the underside 21 of the screen 20 from the first exit opening 29 of the peripheral gap 22 towards the end piece 26/second exit opening 31 of the peripheral gap 22.

Now referring to FIG. 11, the underside 21 of the first portion 20' of the screen 20 may be arranged to have a varying distance R from the rotation axis A of the roller 10. The varying distance R may decrease from the injection opening 24 towards the first exit opening 29 such that the width W of the peripheral gap 22 between the roller surface 11 and the underside 21 of the screen 20 is decrease by up to e.g. 40% at the first exit opening 29 compared to the width of the peripheral gap 22 at the injection opening 24. To receive the projections on the roller 10 grooves may be formed in the underside 21. Alternatively, the projections may be bendable, allowing for the projections 13 on the roller 10 to be received in the peripheral gap 22 by bending.

Figure 14:
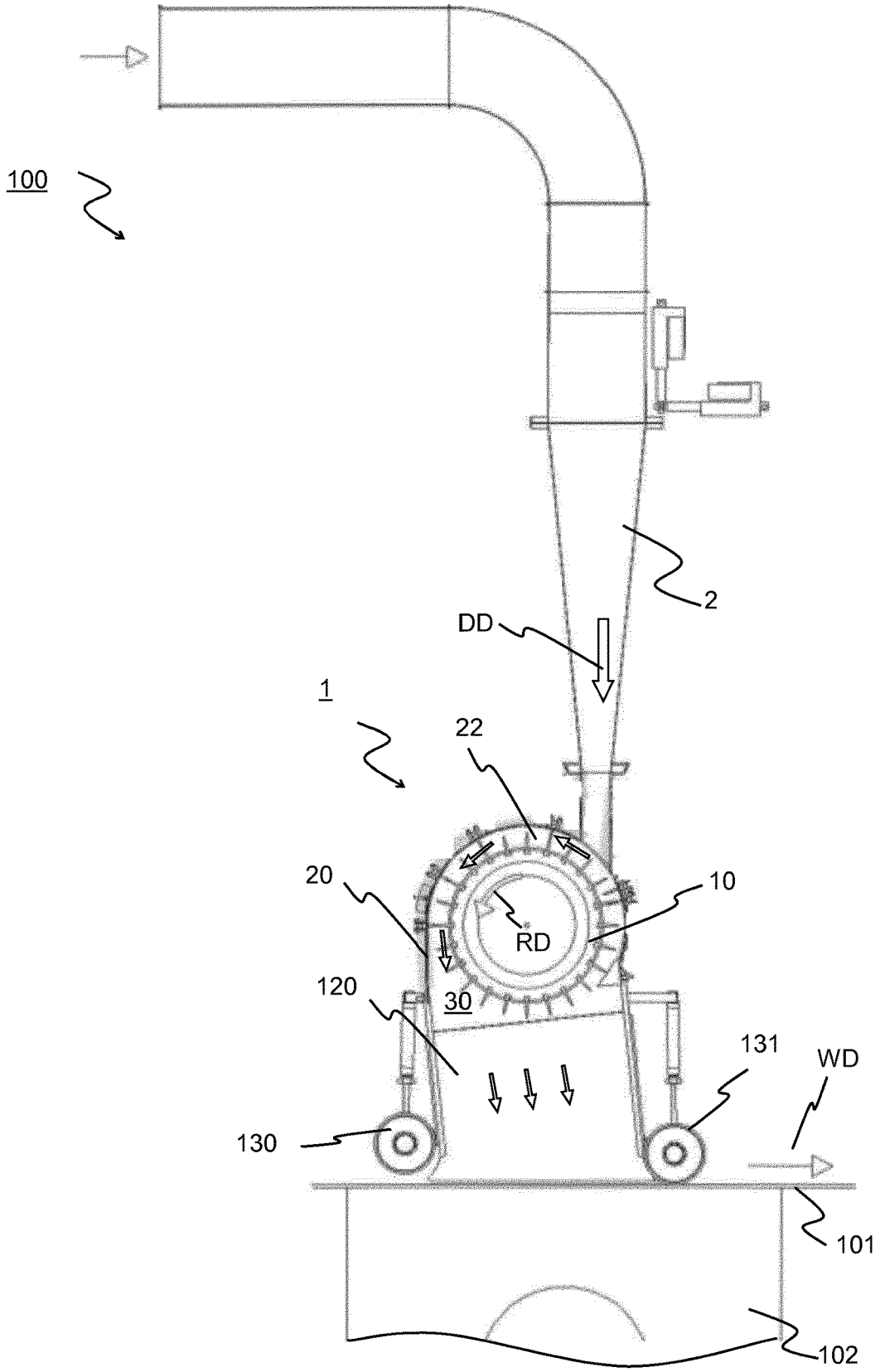
FIG. 14 illustrates a cross sectional view of an apparatus according to the invention comprising a former head according to the invention.

Referring now to FIG. 14, an apparatus 100 according to the invention is shown comprising the former head 1 according to the invention and as described above, wherein the apparatus 100 further comprises a former wire 101 being moved conveying direction, i.e. in a wire direction WD, and a vacuum suction box 102 configured for sucking the fibres individualised by the former head 1 towards and onto the former wire 101. The screen 20 and the end walls 30 may extend towards or to the former wire 101. The wall plates 120 may be transparent in order to provide a visual view into the forming wire 101 being arranged below the former head 1.

The apparatus 100 may further comprise a first and a second web roller 130, 131 wherein the provided fibrous web may leave the former head by being transported between the second web roller 131 and the former wire 101. The first and second web roller 130, 131 may be moveable or adjustable towards and away from the former wire 101 by means of adjusting means such as pistons 232, also shown in FIG. 3. The first and second web roller 130, 131 may further prevent that the fibres below the former head 1 is blown around in a turbulent way by unwanted airflows entering between the former head 1 and/or the wall plates 120 and the former wire 101, so that a fibrous web having an irregular g/m2 profile is provided.

Figure 12:
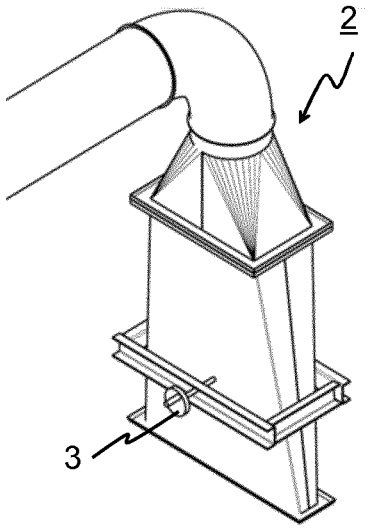
FIG. 12 illustrates a perspective view of an injection inlet.
Figure 13:
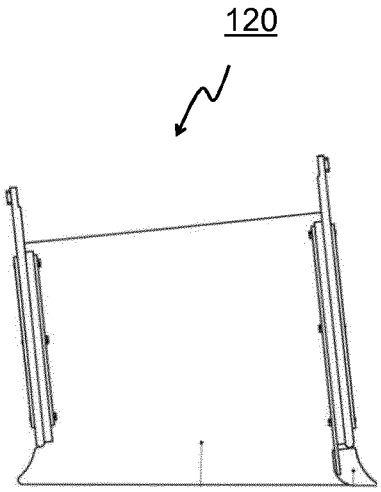
FIG. 13 illustrates an example of wall plates provided between the former head and the former wire.

Referring to FIG. 12, the injection inlet 2 shown in the presently illustrated embodiment is compatible with a longitudinal injection opening 24 in the screen 20 of the former head 1. The injection inlet 2 may further be provided with regulating means 3 for regulation of the velocity of the mixture of fibres and air through the injection inlet 2 and/or for regulating the thickness/weight, such as the g/m$^2$ profile, of the provided fibrous web.

Referring now to FIGS. 15*a*-17*b*, the former head 1 may be connected to an apparatus 100 identical to the apparatus shown in FIG. 14. In all the embodiments shown in FIGS. 15*a*-17*b*, the former head 1 is positioned above the former wire 101 and a suction box 102 is configured for applying suction underneath the former head 1. By using a suction box underneath the former wire and the former head, it is possible to enhance the distribution of the fibres during the step of conveying the fibres onto the former wire 101 as the former wire moves the fibers in the conveying direction, i.e. in a wire direction WD. Fibres are supplied to the former head 1, normally in an entangled form, suspended in an airstream. The airstream with the fibres enters the former head 1 via at least one former head injection inlet 2, in a delivery direction DD opposite the rotation direction RD of a roller 10.

Figure 15A:
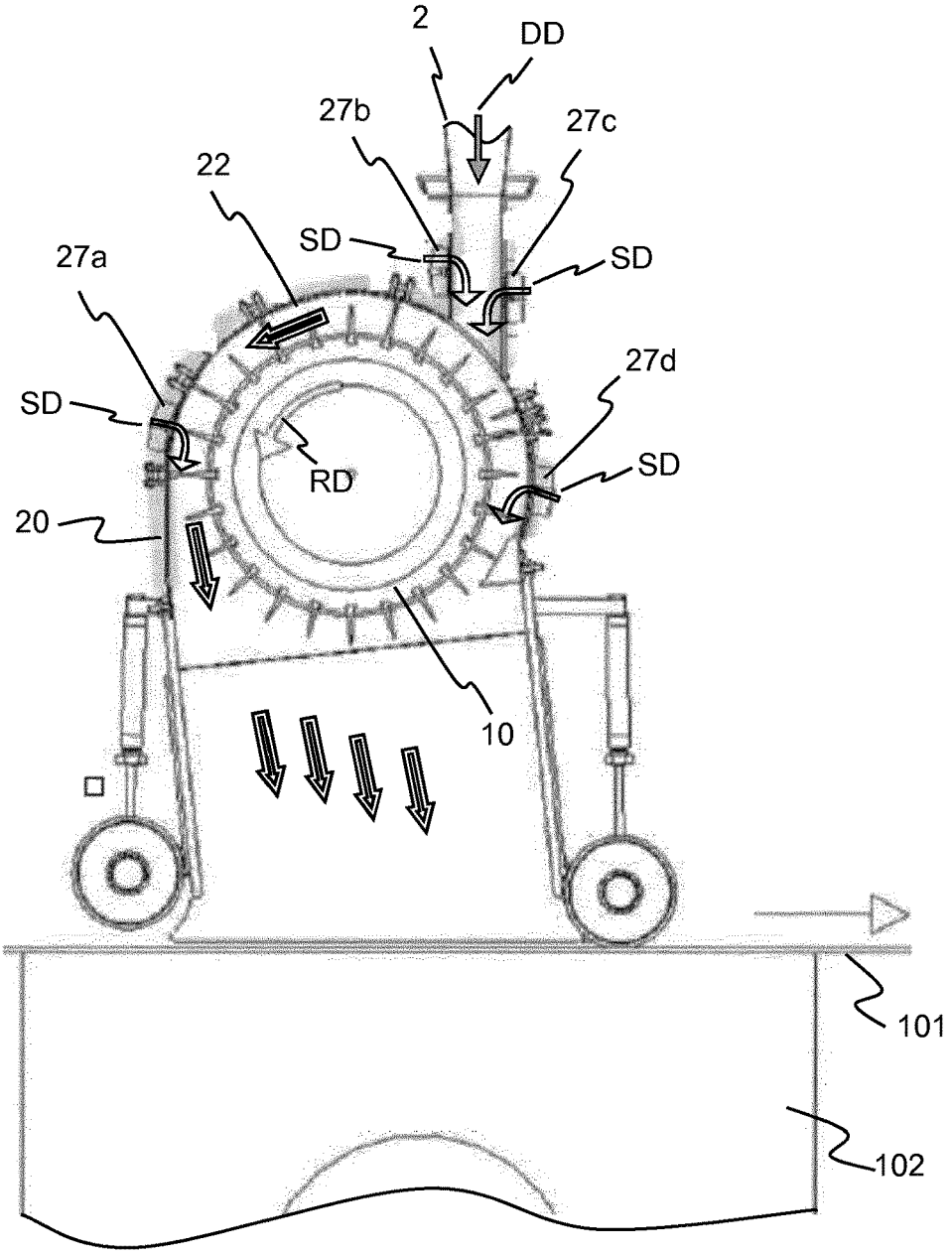
FIGS. 15A-15B illustrate a former head according to the invention.
Figure 15B:
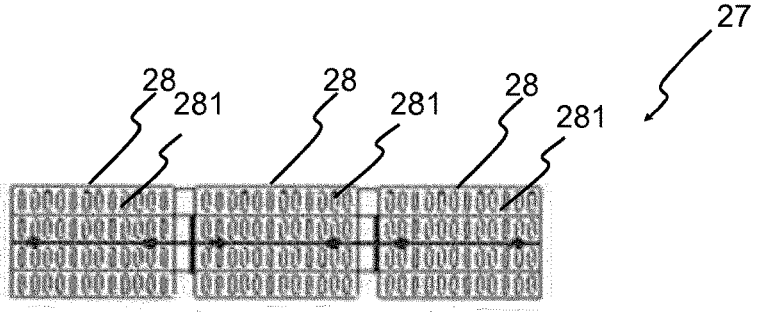

FIGS. 15A-15B show, the former head 1 according to first embodiment of the invention used for forming of fibrous web. The air inlet 27 comprises at least one perforated plate 28, preferably three perforated plates 28 as shown in FIG. 15*b*. The perforated plate 28 can be arranged along the circumference of the screen 20 and each perforated plate 28 is slidable relative to the screen 20 between an open and a closed position. Each perforated plate 28 may include a number of holes 281 having a diameter of 1-10 mm, preferable 2-8 mm, most preferably 2-5 mm.

In FIG. 15*a*, the air inlets 27 are designated as with the reference numbers 27*a* to 27*d*. Air inlet 27*a* represents a first preferred position for the air inlet, air inlet 27*b* represents a second preferred position for the air inlet, air inlet 27*c* represents a third preferred position for the air inlet, and air inlet 27*d* represents a fourth preferred position for the air inlet. Each of the air inlets 27*a*, 27*b*, 27*c*, 27*d* allows an airstream to flow into the peripheral gap 22 in the supply direction SD towards or substantially towards the rotation axis A of the roller 10. The supply direction SD of the airstream will depend on the position of the individual air inlet. As shown in FIG. 15A, it is possible to position one air inlet 27*a* along the circumference of the screen 20 or arrange one or more air inlets 27*b*, 27*c* on the surface of the former head injection inlet 2. The airstream SD is guided to flow in the rotation direction RD of the roller 10 when encountering the roller 10 and/or entering the peripheral gap 22. In a fourth preferred position for the air inlet 27*d*, it is also possible to arrange the air inlet 27*d* at the second portion 20" of the screen 20. The airstream SD enters through the air inlet 27*d*, where the airstream SD will be guided to flow in the opposite direction of the rotation direction RD of the roller 10 when encountering the roller 10 and/or entering the peripheral gap 22. Beside the above mentioned positions for the air inlet, it is also possible to combine the air inlets 27*a* with air inlets 27*b*, air inlets 27*a* with air inlets 27*c*, air inlets 27*a* with air inlets 27*d* etc. The screen 20 would have a number of apertures for allowing the flow of air to enter the peripheral gap 22 and the number of apertures and position of the apertures corresponds to the number and position of the air inlet.

The air inlets 27 would as mentioned before be operable between an open and a closed position by movement of the least one perforated plate 28 arranged at the air inlet 27. Movement of the perforated plate 28 can either be achieved by a manual operation performed by a machine operator or by an actuator being connected to the controller of the apparatus 100.

The airstream DD containing the fibres can be construed as the primary airstream and the airstream SD can be construed as a secondary airstream. The airstream DD enters the former head 1 via at least one former head injection inlet 2, in a delivery direction DD opposite the rotation direction RD of a roller 10.

Figure 16A:
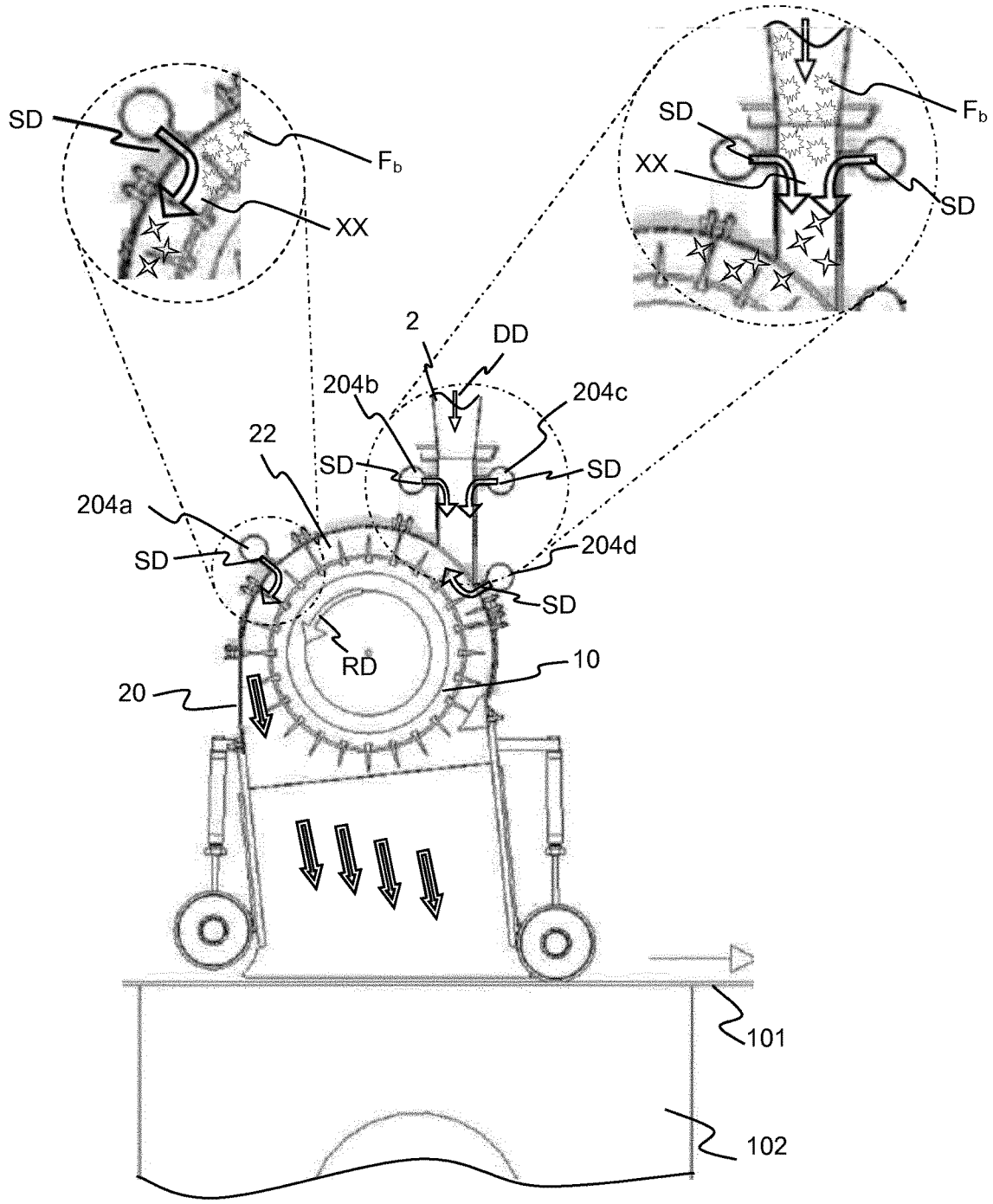
FIGS. 16A-16B illustrate a former head having at least one manifold arranged on the circumference of the screen.
Figure 16B:
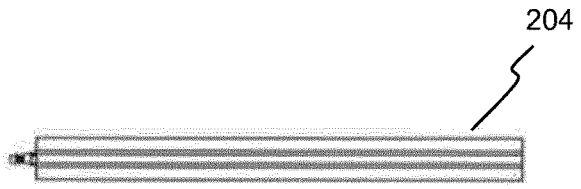

FIGS. 16A-16B show a second embodiment of the former head 1 according to the present invention used for forming of fibrous web, where one or more air inlet can be arranged along the circumference of the former head 1. In the second embodiment of the former head, the air inlets are formed as a number of air inlet manifolds via a number of holes for allowing air to be blown into the former head 1. The air inlet manifolds are designated as with the reference numbers 204*a*, 204*b*, 204*c*, 204*d*. The air inlet manifold 204*a* represents a first preferred position for the air inlet, the air inlet manifold 204*b* represents a second preferred position for the air inlet, the air inlet manifold 204*c* represents a third preferred position for the air inlet, and the air inlet manifold 204*d* represents a fourth preferred position for the air inlet.

The air inlet manifolds may be connected to an air supplying source such as an air pressure system for delivering compressed air to the former head 1 of the apparatus, more specifically for delivering compressed air into the peripheral gap 22 of the screen 20. The air pressure system may be configured for regulation the air pressure, which can be achieved by a regulating element such as a valve. In the presently illustrated embodiment the provided peripheral gap 22 has a constant or substantially constant width W. Instead, the screen 20 may be formed with a decreasing width continually decreasing from the injection opening in the screen and in the rotation direction of the roller as shown in FIG. 11.

As shown in FIG. 16A, it is possible to position a number of air manifold 204*a*, 204*d* along the circumference of the screen 20 or position a number of air manifolds 204*b*, 204*c* on the surface of the former head injection inlet 2. The airstream SD is guided to flow in the rotation direction RD of the roller 10 and the airstream will be conveyed into peripheral gap 22. In a fourth preferred position for the air inlet 27*d*, it is also possible to arrange the air inlet 27*d*. The airstream SD is guided to flow in the opposite direction of the rotation direction RD of the roller 10 when encountering the roller 10 and/or entering the peripheral gap 22. Beside the above mentioned positions for the air inlet, it is also possible to combine the air inlets 204*a* with air inlets 27*b*, air inlets 27*a* with air inlets 27*c*, air inlets 27*a* with air inlets 27*d* etc.

The airstream DD containing the fibres can be construed as the primary airstream and the airstream SD can be construed as a secondary airstream. The airstream DD enters the former head 1 via at least one former head injection inlet 2, in a delivery direction DD opposite the rotation direction RD of a roller 10.

Figure 17A:
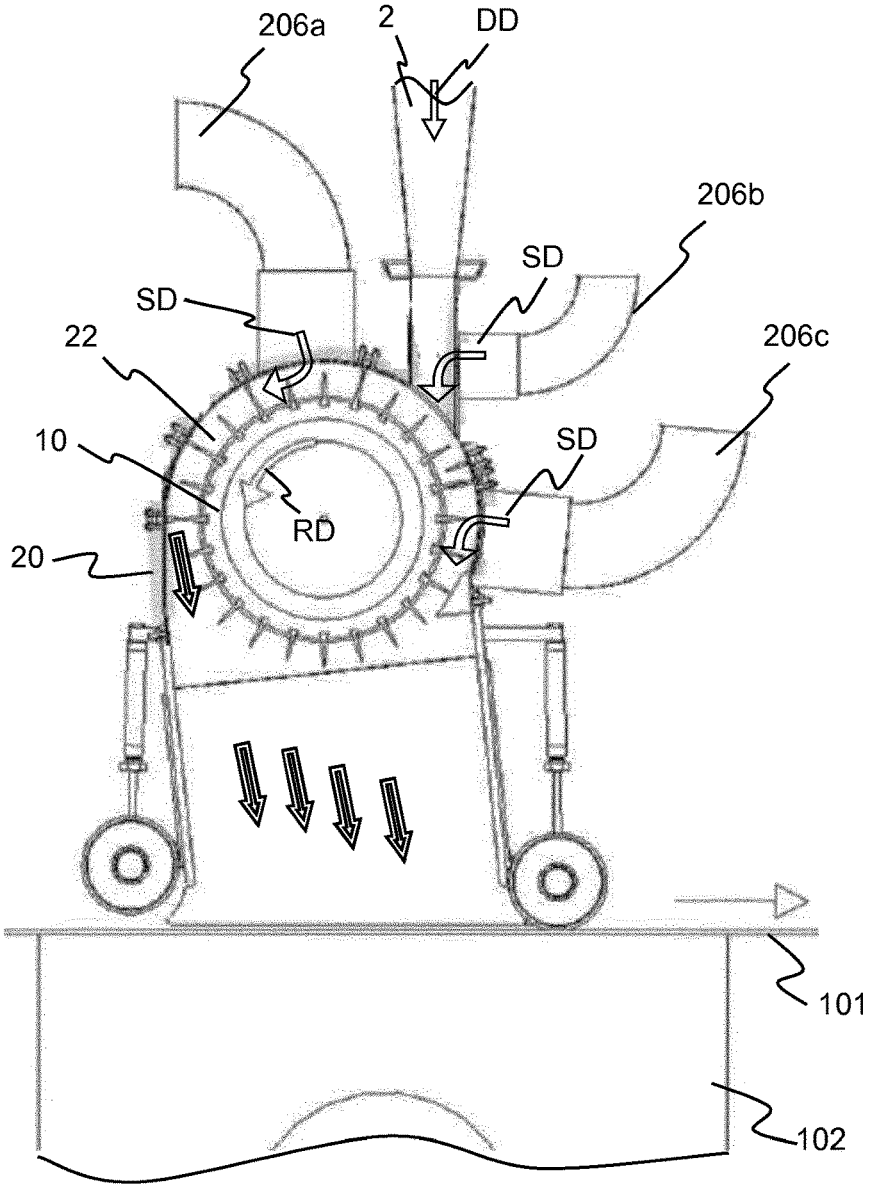
FIGS. 17A-17B illustrate a former heads according to a third embodiment, where a having at least one blasting unit arranged on the screen.
Figure 17B:
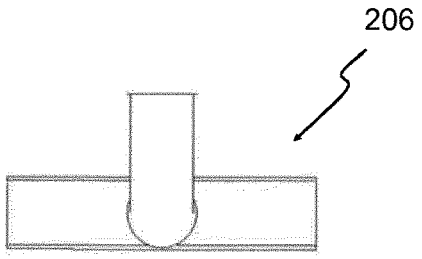

FIGS. 17A-17B show the former head 1 according to a third embodiment of the invention used for forming of fibrous web, where one or more air inlets can be arranged along the circumference of the former head 1. In the third embodiment of the former head, the air inlets are formed as a number of air blasting units for allowing air to be blown into the former head 1.

In FIG. 17*a*, the air blasting units are designated as with the reference numbers 206*a*, 206*b*, 206*c*. The air blasting unit 206*a* represents a first preferred position for the air inlet, the air blasting unit 206*b* represents a second preferred position for the air inlet, the air blasting unit 206*c* represents a third preferred position for the air inlet.

As shown in FIG. 17A, it is possible to position one or more air blasting units 206*a* 206*c* along the circumference of the screen 20 or arrange an air blasting unit 206*b* on the surface of the former head injection inlet 2. The airstream SD is guided to flow in the rotation direction RD of the roller 10 and the airstream will enter the peripheral gap 22. In a third preferred position for the air blasting unit 206*c*, it is also possible to arrange the air inlet 27*d*. The airstream SD is guided to flow in the opposite direction of the rotation direction RD of the roller 10 when encountering the roller 10 and/or entering the peripheral gap 22. Beside the above mentioned positions for the air inlet, it is also possible to combine the air inlets 27*a* with air inlets 27*b*, air inlets 27*a* with air inlets 27*c*, air inlets 27*a* with air inlets 27*d* etc.

Each of the air blasting units may be connected to an air supplying source such as a high pressure fan for delivering compressed air to the former head of the apparatus, more specifically for delivering compressed air into the peripheral gap 22 of the screen 20. The air pressure system may be configured for regulating the air pressure, which can be achieved by regulating the speed of the fan on the ventilator. In the presently illustrated embodiment the provided peripheral gap 22 has a constant or substantially constant width W. Instead, the screen 20 may be formed with a decreasing width continually decreasing from the injection opening in the screen and in the rotation direction of the roller as shown in FIG. 11.

Independent of the position of the air blasting unit 206*a*-206*c*, the air inlets are formed for allowing an airstream to flow into the peripheral gap 22 in the supply direction SD towards or substantially towards the rotation axis A of the roller 10. The supply direction SD of the airstream will depend on the position of the air inlet.

Figure 18:
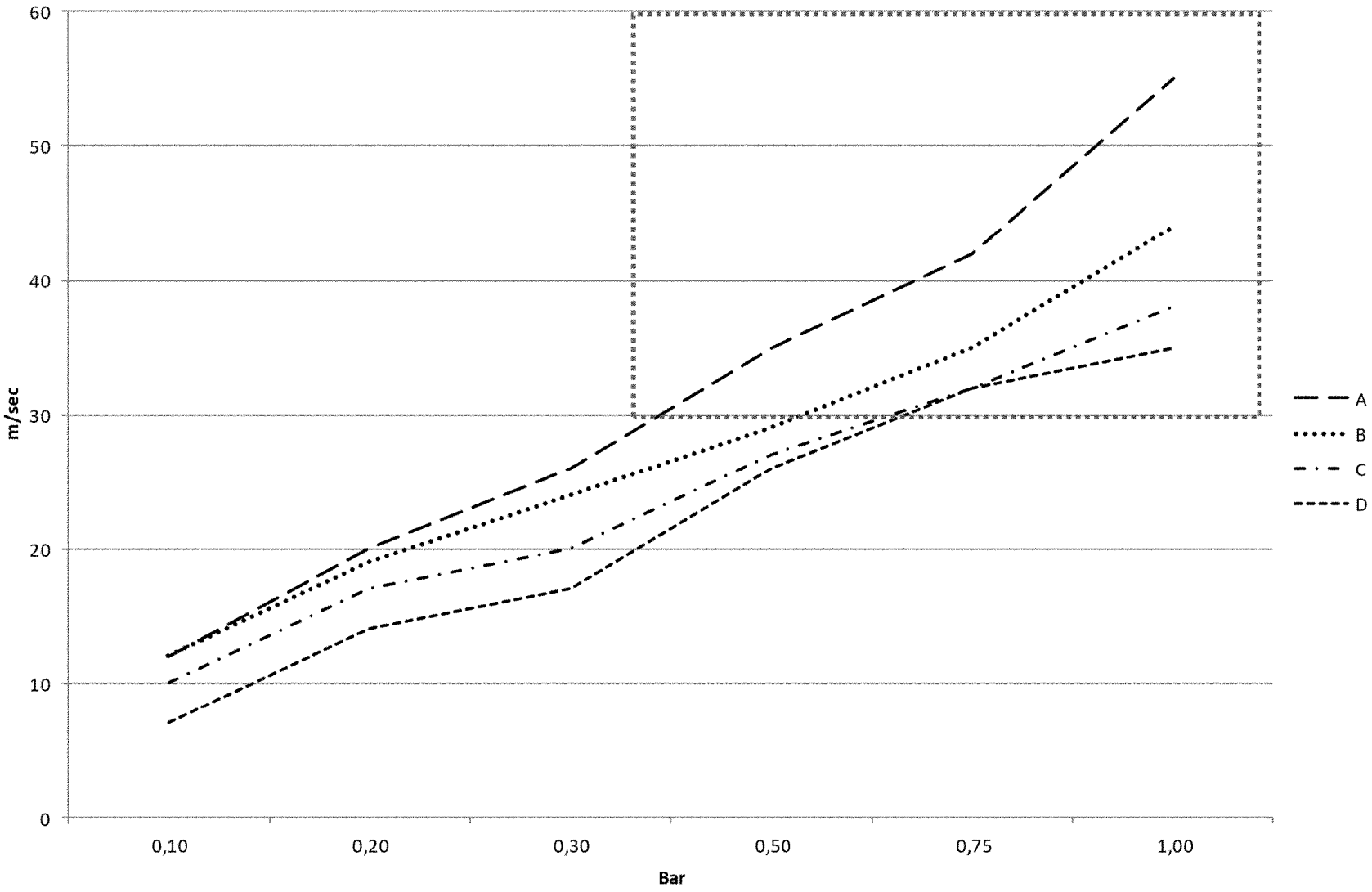
FIG. 18 illustrates a flow diagram.

FIG. 18 illustrates a flow diagram for a specific hole size according to a preferred embodiment of the air inlet. As mentioned with reference to FIGS. 15A-15B, the air inlet 27 may comprise at least one perforated plate 28 with a number of holes 281. Each perforated plate 28 can be arranged along the circumference of the screen 20 and each perforated plate 28 is slidable relative to the screen 20 between an open and a closed position. Dependent on the diameter of the holes 281 in each perforated plate 28, the air flow into the peripheral gap 22 of the screen 20 will vary. As shown in the flow diagram, the best possible fibre dispersion was with an airflow in the region of 30 to 60 m/s and 0.4 to 1.0 bar.

The measurement was obtained by supplying compressed air to a perforated plate at 0.1-1.0 bar. The diameter of the hole 281 in the perforated plate was in the range of 2-5 mm. The specific test result shown in FIG. 18 was obtained with a perforated plate having a hole diameter of 2 mm. The test was performed by using a manometer to measure the air inflow pressure of the compressed air flow at a position before the air flow passed through the hole in the perforated plate, so that it was possible to compare the air flow at four different measuring points after the compressed air had passed through the hole. The first graph A depicts a measurement obtained at a distance of 8 mm from the hole. The second graph B depicts a measurement obtained at a distance of 16 mm from the hole. The second graph B depicts a measurement obtained at a distance of 16 mm from the hole. The fourth graph D depicts a measurement obtained at a distance of 32 mm from the hole.

The test was performed on a former head having a setup as described with reference to FIGS. 15A, 16A and 17A.

In one specific test, the former head included two air inlets, where the air inlets were arranged at the positions 204*a* and 204*b* shown in FIG. 16A. Each of the air inlets included a manifold and a perforated plate (screen) arranged below the manifold. In the test set up, each of the perforated plates included a number of holes arranged in one row where the holes were arranged in a distance of one another.

Figure 19A:
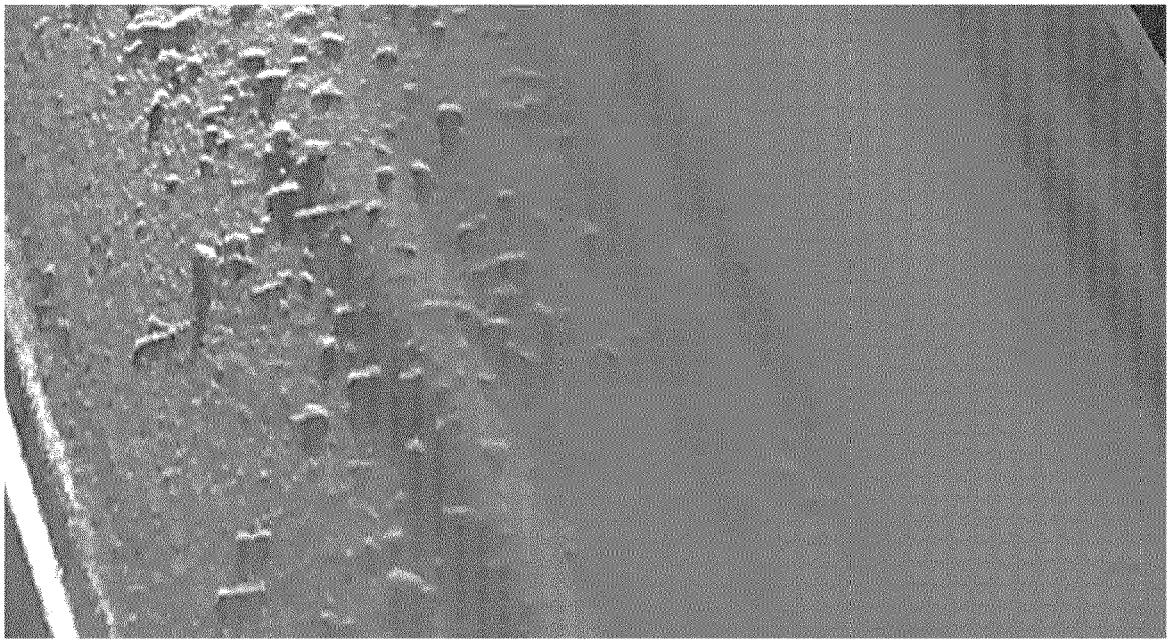
FIGS. 19A-19B depict a sample produced by using a former head according to the invention.
Figure 19B:
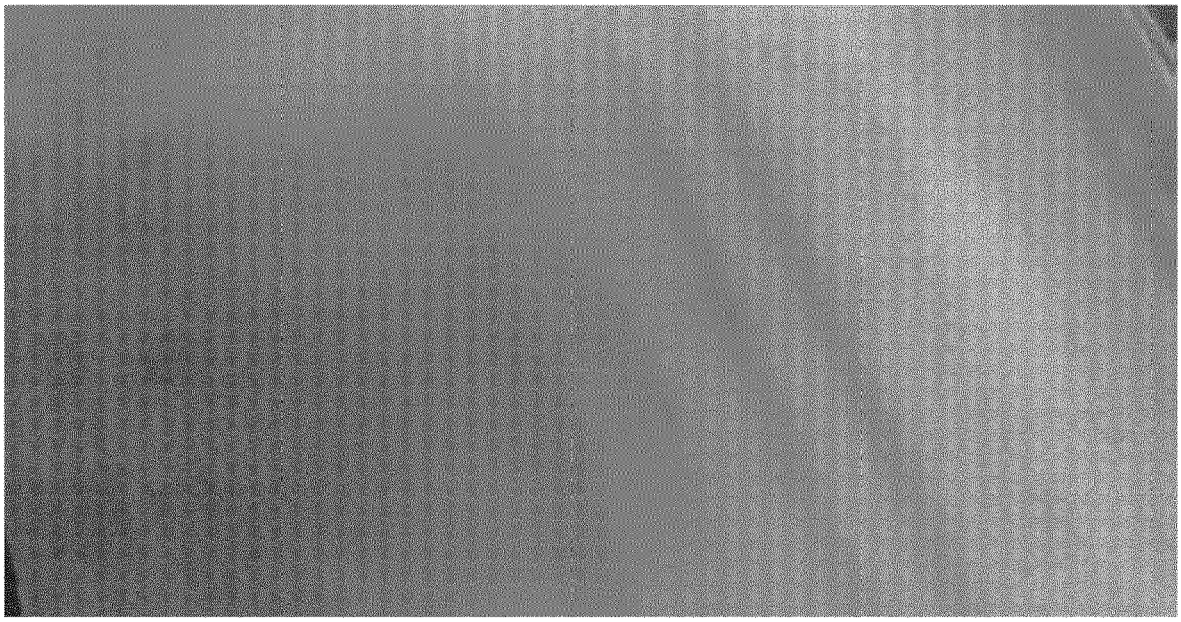

FIG. 19A shows a fiber web formation 101 produced by a former head having two air inlets, where the airflow into the peripheral gap 22 of the screen 20 was disabled, so that an airflow through the air inlets 204*a* and 204*b* (shown in FIG. 16A was not possible. It is evident from FIG. 19A, that the fiber lumps consist of a lots of single fibers being entangled together and without an airflow through the air inlets web formation and appearance is not in the desired quality. FIG. 19B is showing an improved fiber web formation and appearance on the former wire 101, when an airflow is able to pass through the air inlets. By using two air inlets at the position 204*a* and 204*b* (see FIG. 16A), it is possible allow compressed air to be forced into the manifold at position 204*a* and 204*b*.

In the test, the fiber used was 100% fluff pulp, type GP 4822 (Cellulose fibers) and the pulp fibers are fiberized in a hammer mill and via air stream using a suction fan for the transport of fibers to the forming head. The process air temperature was 25 degree C. and humidity: 65%. The former head (forming head) had a working width of 600 mm. The produced fiber web at forming wire 101 had the following: 40 gram/m2 at capacity of 50 kg/h. The perforated plate arranged below the manifold includes a number of holes of ø3.0 mm arranged in one row in a direction being perpendicular to the wire direction WD at each of the air inlet positions 204*a* and 204*b*. The distance between each hole was 6.0 mm from center to center of each hole. In the test, the former head was installed with 166 holes per 1000 mm working width per position for each air inlet. The rotational speed (RPM) of the needle rotor was 2500 RPM (31 m/sec at the needle tip speed). Compressed air was delivered into the former head at 0.9 bar and the airflow in each nozzle according to FIG. 18 was set to 50 m/sec Even though the test was performed on a former head with air inlets positioned as shown in FIG. 16A, the same effect would also be achievable for a former head having air inlets as shown in FIG. 15A and FIG. 17A.

The present invention provides a teaching on how to obtain a better and more unified fibre distribution. According to the invention and the sample shown in FIG. 19B, small fiber lumps are dispersed in the process airflow inside the former head (forming head) and at the peripheral gap 22 (fiber inlet canal) of the screen 20. By using a number of air inlets, the end result is an even better fiber web formation and appearance at the forming wire 101. The air inlets could be arranged on the circumference of the screen or on the surface of the injection inlet 2 or any other position, where the air inlets could ensure a high airflow, hereby enabling that the fiber lumps would be dispersed in this position, by using compressed air. The fiber lumps Fb would be dispersed in the region XX shown in FIG. 16A. Each air inlet comprises a manifold and one or more perforated plates with holes positioned below the manifold.

What is claimed is:

1. A former head for forming a fibrous web, where fibers are supplied to the former head mixed with air via at least one injection inlet, the former head comprising:

a) a roller being rotatable in a rotation direction around a rotation axis and comprising:

a roller surface surrounding the rotation axis, and a plurality of first projections extending outwardly from the roller surface, b) a screen extending along at least part of the roller surface above the rotation axis, the roller surface and the screen defining therebetween a peripheral gap, and c) the injection inlet being positioned to conduct the mixture of the fibers and air into the peripheral gap in a delivery direction, wherein said delivery direction is opposite to the rotation direction of the roller, and said screen comprising a plurality of air inlets being configured for communicating with the peripheral gap and arranged before the injection inlet when viewed in the rotation direction of the roller.

2. The former head according to claim 1, wherein each air inlet comprises one or more perforated plates arranged along the circumference of the screen and said perforated plates being slidable relative to the screen between an open and a closed position.

3. The former head according to claim 1, wherein each air inlet comprises one or more manifold arranged along the circumference of the screen or each air inlet comprises one or more air blasting units arranged on the screen.

4. The former head according to claim 1, wherein the plurality of first projections are formed by needles, needle strips, a carding plate, carding plate segments, carding wires, blade flails, a rasping plate, or rasping plate segments.

5. The former head according to claim 1, wherein an underside of the screen is provided with a plurality of second projections extending outwardly from the underside of the screen.

6. The former head according to claim 5, wherein the plurality of second projections are formed by needles, needle strips, a carding plate, carding plate segments, carding wires, a rasping plate, or rasping plate segments.

7. The former head according to claim 5, wherein said plurality of second projections extend radially outwardly from the underside of the screen.

8. The former head according to claim 1, wherein the screen comprises an injection opening extending along the rotation axis of the roller, the injection opening in the screen at least partially or fully dividing the screen into two portions, a first portion extending from the injection opening and along the rotation direction of the roller and a second portion extending from the injection opening and in a direction opposite of the rotation direction of the roller.

9. The former head according to claim 8, underside of the first portion of the screen comprises a first group of a plurality of second projections.

10. The former head according to claim 9, wherein the plurality of second projections are formed by needles, needle strips, a carding plate, carding plate segments, carding wires, a rasping plate, or rasping plate segments.

11. The former head according to claim 1, wherein the peripheral gap has a decreasing width seen from the injection inlet and in the rotation direction of the roller.

12. The former head according to claim 1, wherein the plurality of first projections and a plurality of second projections on both the roller surface and an underside of the screen are needles, the width of the peripheral gap and a length of the needles on the underside of the screen and a length of the needles on the roller surface of the roller being adapted to provide a needle overlap of the needles extending from the underside of the screen and from the roller surface.

13. The former head according to claim 1, further comprising a perforated plate extending along at least part of the roller surface below the rotation axis and being shaped substantially like the periphery of the roller surface.

14. The former head according to claim 13, wherein said perforated plate extends in continuation of the screen.

15. The former head according to claim 1, wherein said plurality of first projections extend radially outwardly from the roller surface.

16. An apparatus for depositing fibers on a forming wire comprising:

at least one former head according to claim 1, and a forming wire configured to move in a direction and for receiving the fibres fibers from the at least one former head.

* * * * *